US006436597B2

(12) United States Patent
Maruyama et al.

(10) Patent No.: US 6,436,597 B2
(45) Date of Patent: Aug. 20, 2002

(54) ELECTROPHOTOGRAPHIC PHOTOSENSITVE MEMBER, PROCESS FOR PRODUCING ELECTROPHOTOGRAPHIC PHOTOSENSITIVE MEMBER, AND PROCESS CARTRIDGE AND ELECTROPHOTOGRAPHIC APPARATUS WHICH HAVE THE ELECTROPHOTOGRAPHIC PHOTOSENSITIVE MEMBER

(75) Inventors: Akio Maruyama, Tokyo; Shoji Amamiya, Numazu; Michiyo Sekiya, Mishima; Hiroki Uematsu, Shizuoka-ken, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/225,709

(22) Filed: Jan. 6, 1999

(30) Foreign Application Priority Data

Jan. 7, 1998 (JP) ..... 10-001351

(51) Int. Cl.[7] ..... G03G 5/05; G03G 5/147

(52) U.S. Cl. ..... 430/59.6; 430/66; 430/67; 430/130; 430/132; 430/133; 399/159; 399/116

(58) Field of Search ..... 430/59.6, 96, 56, 430/66, 67, 130, 132, 133; 399/159, 116

(56) References Cited

U.S. PATENT DOCUMENTS 4,296,190 A 10/1981 Hasegawa et al. ..... 430/57
5,374,494 A * 12/1994 Kashimura et al. ..... 430/67
5,385,794 A 1/1995 Nagahara et al. ..... 430/67
5,391,446 A * 2/1995 Ohtani et al. ..... 430/59.6
5,391,449 A 2/1995 Maruyama et al. ..... 430/66
5,422,210 A 6/1995 Maruyama et al. ..... 430/59
5,543,257 A * 8/1996 Suzuki et al. ..... 399/159

FOREIGN PATENT DOCUMENTS

JP 127652 5/1990
JP 3-246551 * 11/1991 ..... 430/66

OTHER PUBLICATIONS

English translation of JP 3–246551, Nov. 1991.*

Derwent Abstract 91–365902/50 of JP 3–246551 (Pub Nov. 1991) Attached to JP 3–246551.*

Japio Abstract AN 91–246551 of JP 3–246551 (Pub Nov. 1991).*

Paperchem2 Abstract AN 92:7708 of JP 3–246551 (Pub Nov. 1991).*

Database WPI, Section Ch, Week 9205, Derwent Publ., AN92–036539, for JP 03–282577.

Patent Abstracts of Japan, vol. 8, No. 14, (P–249), Jan. 1984 for JP 58–173747.

* cited by examiner

*Primary Examiner*—Christopher Rodee
(74) *Attorney, Agent, or Firm*—Fitzpatrick, Cella, Harper & Scinto

(57) ABSTRACT

An electrophotographic photosensitive member has a support and a photosensitive layer formed thereon. The electrophotographic photosensitive member has a surface layer containing a charge-transporting material and a resin obtained by exposing to radiations a compound having an acryloyloxy group or methacryloyloxy group to cure.

14 Claims, 1 Drawing Sheet

FIGURE
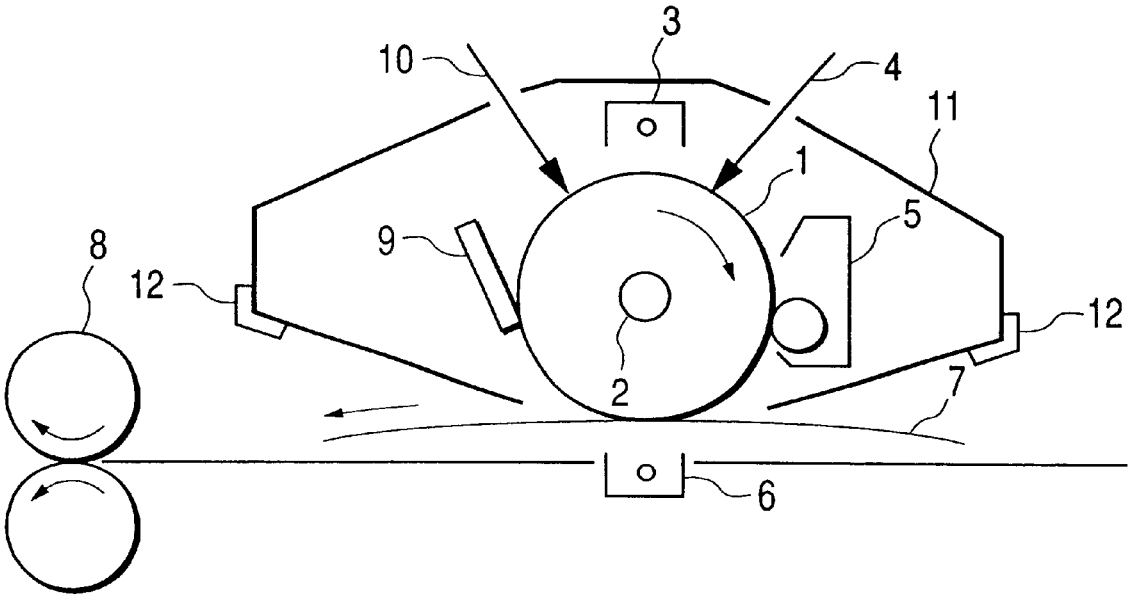

ELECTROPHOTOGRAPHIC PHOTOSENSITVE MEMBER, PROCESS FOR PRODUCING ELECTROPHOTOGRAPHIC PHOTOSENSITIVE MEMBER, AND PROCESS CARTRIDGE AND ELECTROPHOTOGRAPHIC APPARATUS WHICH HAVE THE ELECTROPHOTOGRAPHIC PHOTOSENSITIVE MEMBER

BACKGROUND OF THE INVENTION

1. Field of the Invention

This invention relates to an electrophotographic photosensitive member, a process for producing it, and a process cartridge and an electrophotographic apparatus which have the electrophotographic photosensitive member. More particularly, the present invention relates to an electrophotographic photosensitive member having a surface layer containing a specific resin, a process for producing it, and a process cartridge and an electrophotographic apparatus which have such an electrophotographic photosensitive member.

2. Related Background Art

In recent years, as materials used in electrophotographic photosensitive members, organic photoconductive materials are put into wide use because of their advantages such that they are causative of no environmental pollution and have a high productivity. In order to satisfy both electrical properties and mechanical properties, such electrophotographic photosensitive members are often utilized as photosensitive members of a function-separated type having a charge generation layer and a charge transport layer which are formed superposingly.

Meanwhile, as a matter of course, electrophotographic photosensitive members are required to have sensitivities, electric properties and also optical characteristics in accordance with electrophotographic processes applied.

In particular, to surface layers of photosensitive members used repeatedly, electrical and mechanical external force such as charging, exposure, development by toner, transfer to paper and cleaning is applied, and hence the surface layers are required to have durability to these. Stated specifically, they are required to have a durability to decrease in sensitivity, decrease in charging performance and increase in residual potential, and also to surface wear and scratching. In addition, the surface layers are required to have good properties in respect of transfer of toner images and cleaning for removing residual toner, and are required to have a small surface energy and a high lubricity for that purpose. Also, these performances are desired not to lower during repeated service.

It has been difficult for electrophotographic photosensitive members making use of organic photoconductive materials, to satisfy the above performances, in particular, the durability (or running performance).

Surface layers of the electrophotographic photosensitive members making use of organic photoconductive materials are commonly thin resin layers, where the properties of resin are very important. As resins that can satisfy the above various performances to a certain extent, acrylic resins and polycarbonate resins are recently put into practical use. However, it does not follow that these resins can satisfy all the performances stated above. In particular, it is hard to say that these resins have a sufficiently high hardness for achieving a much higher running performance. Even when these resins are used as resins for surface layers, the surface layers may wear or have scratches with repeated service. Also, from a demand for higher sensitivity in recent years, low-molecular weight components such as charge-generating materials are often added in a relatively large quantity, so that the low-molecular weight components may become deposited during the storage of electrophotographic photosensitive members. In addition, adhesion of machine oil and resin may cause cracks (solvent cracks).

As a means for solving these problems, use of a curable resin as a resin for the charge transport layer is disclosed in, e.g., Japanese Patent Application Laid-open No. 2-127652. The use of a curable resin as a resin for the charge transport layer to make the charge transport layer cure to effect cross-linking makes its strength higher to bring about an improvement in wear resistance, scratch resistance, deposition resistance and solvent crack resistance against repeated service.

However, the charge transport performance of such a layer containing a organic photoconductive material such as the charge-transporting material and also containing the curable resin depends greatly on the resin. Also, a layer having a sufficiently high hardness tends to decrease in charge transport performance, and tends to increase in residual potential during repeated service. Thus, with a demand for much higher image quality and higher running performance in recent years, it is studied how both the hardness and the charge transport performance can be achieved at a higher level.

SUMMARY OF THE INVENTION

An object of the present invention is to solve the problems the electrophotographic photosensitive members making use of conventional resins as surface layers have had, to thereby provide an electrophotographic photosensitive member that has been improved in wear resistance and scratch resistance by making film hardness higher and also has a good deposition resistance and solvent crack resistance.

Another object of the present invention to provide an electrophotographic photosensitive member that may very less cause changes or deterioration of performances, e.g., an increase in residual potential, and can exhibit a stable performance even during repeated service.

Still another object of the present invention to provide a process for producing the above electrophotographic photosensitive member, and a process cartridge and an electrophotographic apparatus which have the photosensitive member and can maintain a high image quality for a long term.

The present invention provides an electrophotographic photosensitive member comprising a support and a photosensitive layer formed thereon;

which electrophotographic photosensitive member has a surface layer containing a charge-transporting material and a resin obtained by irradiating (i.e., exposing to radiations) a compound having an acryloyloxy group or methacryloyloxy group to cure.

The present invention also provides a process for producing an electrophotographic photosensitive member which has a support and a photosensitive layer formed thereon, the process comprising the step of;

forming a surface layer of the electrophotographic photosensitive member; the surface layer containing a charge-transporting material;

the step comprising the step of irradiating (i.e., exposing to radiations) a solution containing a compound having an acryloyloxy group or methacryloyloxy group, to cure the compound.

The present invention still also provides a process cartridge and an electrophotographic apparatus which have the electrophotographic photosensitive member described above.

BRIEF DESCRIPTION OF THE DRAWING

FIGURE schematically illustrates an example of the construction of an electrophotographic apparatus having a process cartridge having the electrophotographic photosensitive member of the present invention.

DESCRIPTION OF THE PREFERRED EMBODIMENTS

The electrophotographic photosensitive member of the present invention has a surface layer containing a charge-transporting material and a resin obtained by irradiating a compound having an acryloyloxy group or methacryloyloxy group to cure.

In the present invention, the photosensitive member may have any constitution in which as a photosensitive layer a charge generation layer containing a charge-generating material and a charge transport layer containing a charge-transporting material are formed superposingly on a support in this order, in which conversely the charge transport layer and the charge generation layer are formed superposingly in this order, or in which the charge-generating material and the charge-transporting material are contained in the same layer; provided that the surface layer contains a resin obtained by irradiating a compound having an acryloyloxy group or methacryloyloxy group to cure.

In the foregoing, in view of properties required as the electrophotographic photosensitive member, in particular, electrical properties such as residual potential and also running performance, preferred is a function-separated type photosensitive layer in which the charge transport layer is the surface layer. Thus, the present invention is advantageous in that it has become possible to use a curable resin as a binder resin without damaging the properties of the charge-transporting material.

The reason is unclear why a sufficient hardness can be achieved and yet any increase in residual potential does not occur without causing deterioration of the photosensitive member performances when the resin cured by irradiation (exposure to radiations) is used in the surface layer. For one thing, however, materials having a strong polarity or materials having a low oxidation potential are considered to have a greatly ill effect on the achievement of good performance in photosensitive layers. Accordingly, it is presumed that, in the resin used in the present invention, compared with conventional curable resins, such materials having a strong polarity or materials having a low oxidation potential are not produced, or very less produced, in the course of curing reaction.

In use of compounds having similarly the acryloyloxy group or methacryloyloxy group, it is necessary to add a thermo- or photo-reaction initiator when such compounds are cured by heat or ultraviolet light. The curable resin thus obtained and used in the surface layer causes deterioration of photosensitive member performances, e.g., an increase in residual potential and a decrease in sensitivity. Accordingly, the fact that the resin is cured without using such a reaction initiator is also considered to be effective for a superior electrophotographic performance.

The acryloyloxy group or methacryloyloxy group the compound used in the present invention has are $CH_2{=}CHCOO{-}$ and $CH_2{=}CH(CH_3)COO{-}$, respectively.

There are no particular limitations on the compound having the acryloyloxy group or methacryloyloxy group used in the present invention, so long as it is a polymerizable compound which has at least one of these groups and such a group or groups of which cause(s) polymerization reaction upon irradiation.

The compound having the acryloyloxy group or methacryloyloxy group is grouped roughly into a monomer and an oligomer in accordance with the presence or absence of repetition of its structural unit. The monomer is a compound having no repetition of the structural unit having the acryloyloxy group or methacryloyloxy group and having a relatively low molecular weight. The oligomer is herein a polymer having about 2 to 20 repeating units of the acryloyloxy group or methacryloyloxy group. A macromonomer comprising a polymer or oligomer having the acryloyloxy group or methacryloyloxy group only at its terminal may also be used as a curable compound for the surface layer of the present invention.

In the present invention, in view of the achievement of both the running performance and the electrical properties, it is preferred to use the monomer.

The above monomer may be grouped in accordance with the structure of a moiety other than the acryloyloxy group or methacryloyloxy group, and may include alkyl types such as 1,4-butanediol diacrylate and neopentyl glycol diacrylate, alkylene glycol types such as diethylene glycol diacrylate, trimethylolpropane types such as trimethylolpropane triacrylate, pentaerythritol types such as pentaerythritol triacrylate, isocyanurate types such as tris(acryloxyethyl) isocyanurate, and alicyclic types such as dicyclopentanyl diacrylate and ethoxylated hydrogenated bisphenol-A dimethacrylate.

In particular, in the present invention, taking account of the balance of hardness and photosensitive member performances, trimethylolpropane types, pentaerythritol types, isocyanurate types and alicyclic types are preferred.

The oligomer may include epoxy acrylate or methacrylate, urethane acrylate or methacrylate, polyester acrylate or methacrylate, polyether acrylate or methacrylate and silicon acrylate or methacrylate. In the present invention, the oligomer, when used, may preferably be used in the form of a mixture with the above monomer.

Macro-moiety of the macromonomer may include ethylene types, styrene types and acrylic types. In the present invention, the macromonomer, when used, may also be used in the form of a mixture with the above monomer.

The compound having the acryloyloxy group or methacryloyloxy group according to the present invention may also grouped in accordance with the number of functional group in one molecule. Those having one functional group in one molecule are called monofunctional compounds, and those having two or more functional groups in one molecule are called polyfunctional compounds. In the present invention, in view of running performance, polyfunctional compounds may preferably be used, and polyfunctional compounds having three or more acryloyloxy group or methacryloyloxy group in one molecule may more preferably be used.

In the present invention, the compound having the acryloyloxy group or methacryloyloxy group may be used alone or in the form of a mixture of two or more types.

As described previously, the multi-layer type photosensitive member has the charge generation layer containing a charge-generating material and the charge transport layer containing a charge-transporting material. The charge-generating material may include selenium-tellurium, pyrylium or thiapyrylium type dyes; phthalocyanine compounds having various central metal atoms and crystal forms, as exemplified specifically by those having an α, β, γ, ε or X type crystal form; anthanthrone pigments, dibenzopyrene quinone pigments, pyranthrone pigments, trisazo pigments, disazo pigments, monoazo pigments, indigo pigments, quinacridone pigments, asymmetric quinocyanine pigments, quinocyanine pigments, and amorphous silicone disclosed in Japanese Patent Application Laid-open No. 54-143645.

The charge generation layer may be formed by dispersing thoroughly the above charge-generating material together with a 0.3- to 4-fold amount of a binder resin and a solvent by means of a homogenizer, an ultrasonic dispersion machine, a ball mill, a vibrating ball mill, a sand mill (a sand grinder), an attritor or a roll mill, and coating the resultant dispersion, followed by drying. Alternatively, it may be formed as a film with single composition, e.g., a deposited film, of the charge-generating material. The charge generation layer may preferably have a layer thickness of 5 μm or less, and particularly preferably from 0.1 to 2 μm.

The charge-transporting material may include pyrene; carbazole compounds such as N-ethylcarbazole, N-isopropylcarbazole, N-methyl-N-phenylhydrazino-3-methylidene-9-ethylcarbazole and N,N-diphenylhydrazino-3-methylidene-9-ethylcarbazole; hydrazone compounds such as N,N-diphenylhydrazino-3-methylidene-10-ethylphenothiazine, N,N-diphenylhydrazino-3-methylidene-10-ethylphenoxazine, p-diethylaminobenzaldehyde-N,N-diphenylhydrazone, p-diethylaminobenzaldehyde-N-α-naphthyl-N-phenylhydrazone, p-pyrolidinobenzaldehyde-N,N-diphenylhydrazone, 1,3,3-trimethylindolenine-ω-aldehyde-N,N-diphenylhydrazone and p-diethylbenzaldehyde-3-methylbenzazolinone-2-hydrazone; pyrazoline compounds such as 2,5-bis(p-diethylaminophenyl)-1,3,4-oxadiazole, 1-phenyl-3-(p-diethylaminostyryl)-5-(p-diethylaminophenyl)pyrazoline, 1-[quinolyl(2)]-3-(p-diethylaminostyryl)-5-(p-diethylam inophenyl)pyrazoline, 1-[pyridyl(2)]-3-(p-diethylaminostyryl)-5-(p-diethylami nophenyl)pyrazoline, 1-[6-methoxy-pyridyl(2)]-3-(p-diethylaminostyryl)-5-(p-diethylaminophenyl)pyrazoline, 1-[pyridyl(3)]-3-(p-diethylaminostyryl)-5-(p-diethylami nophenyl)pyrazoline, 1-[pyridyl(2)]-3-(p-diethylaminostyryl)-4-methyl-5-(p-diethylaminophenyl) pyrazoline, 1-[pyridyl(2)]-3-(α-methyl-p-diethylaminostyryl)-5-(p-diethylaminophenyl)pyrazoline, 1-phenyl-3-(p-diethylaminostyryl)-4-methyl-5-(p-diethyl aminophenyl)pyrazoline, 1-phenyl-3-(α-benzyl-p-diethylaminostyryl)-5-(p-diethyl aminophenyl)pyrazoline and spiropyrazoline; oxazole compounds such as 2-(p-diethylaminostyryl-6-diethylaminobenzoxazole and 2-(p-diethylaminophenyl-4-(p-dimethylaminophenyl)-5-(chlorophenyl)oxazole; thiazole compounds such as 2-(p-diethylaminostyryl)-6-diethylaminobenzthiazole; triarylmethane compounds such as bis(4-diethylamino-2-methylphenyl)phenylmethane; and polyarylalkanes such as 1,1-bis(4-N,N-diethylamino-2-methylphenyl)heptane and 1,1,2,2-tetrakis-4-N,N-diethylamino-2-methylphenyl) ethane.

In the case when the charge transport layer is the surface layer, the charge transport layer may preferably be formed by coating on the charge generation layer a solution obtained by dissolving in a solvent the charge-transporting material and the compound having the acryloyloxy group or methacryloyloxy group, followed by drying and further followed by irradiation to effect curing. The surface layer in the present invention may also be formed by coating on the charge generation layer a solution obtained by causing previously the compound having the acryloyloxy group or methacryloyloxy group to cure to a certain degree by irradiation and thereafter dissolving it in a solvent together with the charge-transporting material, followed by drying. In view of hardness and deposition resistance, its formation in the order of coating, drying and then irradiation is preferred.

In the present invention, the charge transport layer may be formed in multi-layer structure of two or more layers.

The solvent used may include aromatic solvents such as toluene, xylene and monochlorobenzene, and besides ethers such as dioxane, tetrahydrofuran and tetrahydropyran. Depending on solutes, ketones, alcohols and saturated hydrocarbons may also be used. Processes by which the solutions are coated are known to include dip coating, spray coating, curtain coating and spin coating. In order to mass-produce electrophotographic photosensitive members in a good efficiency, dip coating is the best.

Similarly, in the case when the charge generation layer is the surface layer, the charge generation layer may preferably be formed by coating on the charge transport layer a fluid obtained by dispersing and dissolving in a solvent the charge-generating material, the charge-transporting material and the compound having the acryloyloxy group or methacryloyloxy group, followed by drying and further followed by irradiation to effect curing.

In the case of the single-layer type photosensitive layer, the photosensitive layer preferably be formed by coating on the support or a subbing layer a fluid obtained by dispersing and dissolving in a solvent the charge-generating material, the charge-transporting material and the compound having the acryloyloxy group or methacryloyloxy group, followed by drying and further followed by irradiation to effect curing.

Various additives may be added to the surface layer of the electrophotographic photosensitive member according to the present invention. Such additives may include anti-deterioration agents such as antioxidants and ultraviolet light absorbers, and lubricants such as tetrafluoroethylene resin particles and carbon fluoride.

In the present invention, so long as the remarkable effect of the present invention can be obtained, any of other commercially available resins as exemplified by polycarbonate resins, polyarylate resins and polystyrene resins may also be used in the form of its mixture with the compound having the acryloyloxy group or methacryloyloxy group of the present invention.

In the present invention, in order to achieve much superior electrophotographic performances, it is preferable for the photosensitive layer to have a small specific dielectric constant. Stated specifically, the photosensitive layer cured may preferably have a specific dielectric constant of 4.0 or below, and more preferably 3.5 or below, as a value obtained when an AC current of 1 MHz is applied using aluminum as an electrode.

In order to achieve a superior charge transport performance, what causes electric-charge trapping must be made to occur as less as possible in the photosensitive layer. The specific dielectric constant is considered to reflect the extent of this trapping. Since in the present invention the resin cured by irradiation, as being different from thermoplastic resins, the specific dielectric constant depends on the molecular structure of the compound having not cured and the conditions for the curing reaction. The courses or manners of making small the specific dielectric constant of the photosensitive layer are, e.g., making small the intermolecular polarization of the compound having the acryloyloxy group or methacryloyloxy group, making small the number of residual unreacted groups after curing, and also making deterioration less occur due to radiations.

It is difficult to control these conditions independently. In the present invention, there are no particular limitations on the manner of achieving it so long as the specific dielectric constant is controlled within the preferable values.

The support of the electrophotographic photosensitive member of the present invention may have any support so long as it has a conductivity. Metals or alloys such as aluminum and stainless steel, paper, plastics and the like may be used. There are also no particular limitations on its shape. It may have any desired shape of, e.g., a cylinder or a film in accordance electrophotographic apparatus to which the photosensitive member is applied.

In the present invention, a subbing layer having the function as a barrier and the function of adhesion may be provided between the support and the photosensitive layer.

The subbing layer is formed in order to, e.g., improve adhesion of the photosensitive layer, improve coating performance, protect the support, cover defects of the support, improve the performance of charge injection from the support and protect the photosensitive layer from electrical breakdown. Materials for the subbing layer may include polyvinyl alcohol, poly-N-vinyl imidazole, polyethylene oxide, ethyl cellulose, ethylene-acrylic acid copolymer, casein, polyamide, N-methoxymethylated nylon 6, copolymer nylons, glue and gelatin. The subbing layer is formed by coating on the support a solution prepared by dissolving any of these materials in a correspondingly suitable solvent, followed by drying. The subbing layer may preferably have a layer thickness of from 0.1 to 2 $\mu$m.

In the present invention, for the purpose of covering defects of the support and preventing interference fringes that may occur when interference light is used, a resin layer in which conductive particles have been dispersed may be provided as a conductive layer between the support and the photosensitive layer or between the support and the subbing layer. It may have a layer thickness of from 5 to 30 $\mu$m.

In the present invention, as previously described, the resin in the surface layer is cured by irradiation (exposure to radiations). The radiations used in the present invention are electron rays and gamma rays. In the present invention, in view of absorption efficiency and operational efficiency, it is preferable to use electron rays. In the case when irradiated by the electron rays, any type of accelerator may be used as an accelerator, including a scanning type, an electrocurtain type, a broad beam type, a pulse type and a laminar type. When irradiated by the electron rays, conditions for the irradiation are very important in the photosensitive member of the present invention in order to achieve the intended electric properties and running performance. In the present invention, the electron rays may preferably be applied at an accelerating voltage of 250 kV or below, and most preferably 150 kV or below, and in an irradiation dose in the range of from 1 Mrad to 100 Mrad, and more preferably in the range of from 3 Mrad to 50 Mrad. At an accelerating voltage higher than the foregoing, photosensitive member performances tend to be damaged greatly by the irradiation by electron rays and also it may be difficult to achieve the above preferable specific dielectric constant. In an irradiation dose smaller than the foregoing range, the resin tends to be cured insufficiently. In an irradiation dose larger than the foregoing, the photosensitive member performances tend to deteriorate and also it may be difficult to achieve the above preferable specific dielectric constant.

FIGURE schematically illustrates the construction of an electrophotographic apparatus having a process cartridge having the electrophotographic photosensitive member of the present invention.

In FIGURE, reference numeral 1 denotes a drum type electrophotographic photosensitive member of the present invention, which is driven rotatingly around an axis 2 in the direction of an arrow at a given peripheral speed. The photosensitive member 1 is, in the course of rotation, electrostatically charged uniformly on its periphery to a positive or negative, given potential through a primary charging means 3. The photosensitive member thus charged is then exposed to light 4 emitted from an exposure means (not shown) for slit exposure or laser beam scanning exposure. In this way, electrostatic latent images are formed successively on the periphery of the photosensitive member 1.

The electrostatic latent images thus formed are subsequently developed by toner by the operation of a developing means 5. The toner images formed by development are then transferred successively by the operation of a transfer means 6, to a transfer medium 7 fed from a paper feed section (not shown) to the part between the photosensitive member 1 and the transfer means 6 in the manner synchronized with the rotation of the photosensitive member 1. The transfer medium 7 which has received the images is separated from the surface of the photosensitive member, is led through an image fixing means 8, where the images are fixed, and is then printed out of the apparatus as a copied material (a copy).

The surface of the photosensitive member 1 from which images have been transferred is brought to removal of the toner remaining after the transfer, through a cleaning means 9. Thus, the photosensitive member is cleaned on its surface, further subjected to charge elimination by pre-exposure light 10 emitted from a pre-exposure means (not shown), and then repeatedly used for the formation of images. When the primary charging means 3 is a contact charging means making use of a charging roller, the pre-exposure is not necessarily required.

In the present invention, the apparatus may be constituted of a combination of plural components integrally joined as a process cartridge from among the constituents such as the above electrophotographic photosensitive member 1, primary charging means 3, developing means 5 and cleaning means 9 so that the process cartridge is detachably mountable to the body of the electrophotographic apparatus such as a copying machine or a laser beam printer. For example, at least one of the primary charging means 3, the developing means 5 and the cleaning means 9 may be integrally supported in a cartridge together with the photosensitive member 1 to form a process cartridge 11 that is detachably mountable to the body of the apparatus through a guide means such as a rail 12 provided in the body of the apparatus.

In the case when the electrophotographic apparatus is used as a copying machine or a printer, the exposure light 4 is light reflected from, or transmitted through, an original, or light irradiated by the scanning of a laser beam, the driving of an LED array or the driving of a liquid crystal shutter array according to signals obtained by reading an original through a sensor and converting the information into signals.

The electrophotographic photosensitive member of the present invention may be not only applied in electrophotographic copying machines, but also widely applied in the fields where electrophotography is applied, e.g., laser beam printers, CRT printers, LED printers, liquid-crystal printers and laser beam engravers.

The present invention will be described below in greater detail by giving Examples.

EXAMPLE 1

First, a coating material for a conductive layer was prepared in the following manner. 50 parts (parts by weight; the same applies hereinafter) of conductive titanium oxide powder coated with tin oxide containing 10% of antimony oxide, 25 parts of phenol resin, 20 parts of methyl cellosolve, 5 parts of methanol and 0.002 part of silicone oil (a polydimethylsiloxane-polyoxyalkylene copolymer; weight-average molecular weight: 3,000) were dispersed for 2 hours by means of a sand grinder making use of glass beads of 1 mm diameter. The fluid thus prepared was dip-coated on an aluminum cylinder of 30 mm diameter, followed by drying at 140° C. for 30 minutes to form a conductive layer with a layer thickness of 20 $\mu$m.

Next, 5 parts of N-methoxymethylated nylon was dissolved in 95 parts of methanol. The solution thus obtained was coated on the above conductive layer by dipping, followed by drying at 100° C. for 20 minutes to form an intermediate layer with a layer thickness of 0.6 $\mu$m.

Next, 3 parts of oxytitanium phthalocyanine having strong peaks at Bragg's angles (2θ plus-minus 0.2°) of 9.0°, 14.2°, 23.9° and 27.1° as measured by CuKα characteristic X-ray diffraction, 2 parts of polyvinyl butyral (S-LEC BM2, available from Sekisui Chemical Co., Ltd.) and 35 parts of cyclohexanone were dispersed for 2 hours by means of a sand grinder making use of glass beads of 1 mm diameter, followed by addition of 60 parts of ethyl acetate. The fluid thus obtained was coated on the intermediate layer by dip coating, followed by drying at 100° C. for 15 minutes to form a charge generation layer with a layer thickness of 0.2 $\mu$m.

Next, 7 parts of a charge-transporting material represented by the following formula:

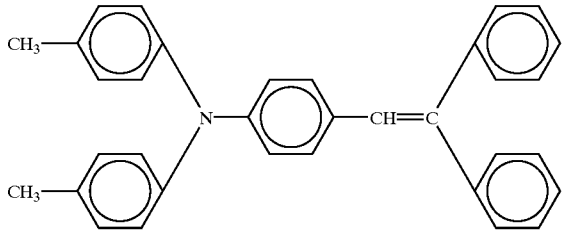

and 10 parts of a compound having an acryloyloxy group, represented by the following formula:

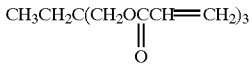

were dissolved in a mixed solvent of 20 parts of dichloromethane and 40 parts of toluene. The solution thus obtained was coated on the above charge generation layer by dip coating, followed by drying at 120° C. for 60 minutes, and further followed by irradiation by electron rays under conditions of an accelerating voltage of 150 kV and an irradiation dose of 10 Mrad to cure the resin, to form a charge transport layer with a layer thickness of 16 $\mu$m. The photosensitive layer having thus cured had a specific dielectric constant of 3.2.

The electrophotographic photosensitive member thus produced was first set in a laser beam printer LBP-SX, manufactured by CANON INC., and its electrophotographic performances [dark-area potential Vd, light-attenuated sensitivity (the amount of light that is necessary for attenuating the surface potential from −700 V to −150 V) and residual potential Vs1 (the potential produced when irradiated by light in the amount three times the amount of light for the light-attenuated sensitivity)] at the initial stage were measured. Then, a 10,000 sheet paper-feeding running test was made, where visual observation was made on whether or not any faulty images occurred, and any scrape of the photosensitive member surface was measured. Also, the same electrophotographic performances as the above were measured after running to determine their respective changed values ΔVd, ΔV1 (the V1 after running is V1 produced when irradiated by light after running in the same amount of light as the amount of light that gives a V1 of 150 V at the initial stage) and ΔVs1. The results are shown in Table 2. In Table 2 shown later, positive values of potential variations indicate that the absolute value of the potential has increased, and negative values indicate that the absolute value of the potential is negative.

Then, using another electrophotographic photosensitive member produced in the same manner as the above, deposition resistance and solvent cracking resistance were also evaluated. With regard to the deposition resistance, a cleaning blade for copying machines, made of urethane rubber, was brought into pressure contact with the photosensitive member surface and then stored at 75° C., to make an accelerated test to examine any deposition of low-molecular weight components on the surface, To make evaluation, the photosensitive member surface was observed with a microscope at intervals of 24 hours until 30 days later at the longest, and whether or not the deposition occurred was judged. With regard to the solvent cracking resistance, resin was made to adhere to the surface of another electrophotographic photosensitive member produced in the same manner as the above, which was left for 24 hours and then 2 days in an environment of normal temperature and normal humidity. Thereafter, whether or not solvent cracking occurred was observed with a microscope.

The results are shown in Table 3.

EXAMPLES 2 to 5

Electrophotographic photosensitive members were produced in the same manner as in Example 1 except that the compound having an acryloyloxy group was replaced respectively with those shown in Table 1. Evaluation was made similarly.

The results are shown in Tables 2 and 3.

As can be seen from Table 2, the photosensitive members of the present invention show very stable and good performances such that they show good electrophotographic performances at the initial stage and cause less scrape and also little changes during running. As also can be seen from Table 3, the photosensitive members of the present invention cause neither deposition nor solvent cracking.

COMPARATIVE EXAMPLES 1 and 2

Electrophotographic photosensitive members were produced in the same manner as in Example 1 except that the binder resins of the charge transport layer were replaced respectively with those shown in Table 1, the compound having an acryloyloxy group was not used and were not irradiated by electron rays. Evaluation was made similarly.

The results are shown in Tables 2 and 3. As can be seen from Tables 2 and 3, the photosensitive members of Comparative Examples cause scrape greatly during running to cause faulty images such as fog, and cause deposition and solvent cracking.

COMPARATIVE EXAMPLE 3

Electrophotographic photosensitive member was produced in the same manner as in Example 1 except that 10 parts of a compound represented by the following formula was added as a polymerization initiator to the same charge transport layer forming solution as that in Example 1 and the electron transport layer was irradiated for 30 sec. provided that the irradiation by electron rays was replaced with irradiation by ultraviolet rays at an intensity of 100 mW/cm$^2$ by means of a metal halide ultraviolet ray irradiator. Evaluation was made similarly.

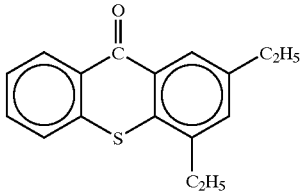

The results are shown in Tables 2 and 3. As can be seen from Tables 2 and 3, in the case of ultraviolet-light curing, the photosensitive member shows a low sensitivity at the initial stage and also a high residual potential even when the same compound as in the present invention is used, so that the images formed are too thin to obtain sharp images.

TABLE 1

| | Example: |
|---|---|
| 1 | $CH_3CH_2C(CH_2OC(=O)CH=CH_2)_3$ |
| 2 | Urethane acrylate oligomer (ART RESIN UN-3320HA, available from Negami Kogyo) |
| 3 | Polystyrene methacrylate oligomer (MACROMER 13K-RC, available from Toagosei)/ pentaerythritol tetramethacrylate (SR-369, available from Toagosei) = 7/3 |
| 4 | 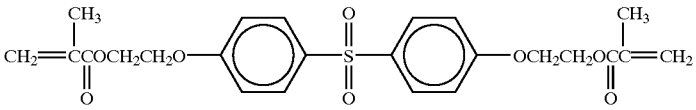 |
| 5 | 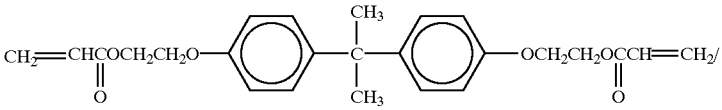 pentaerythritol tetraacrylate (NK ESTER A-TMMT, available from Shin-Nakamura Chemical) = 8/2 |
| | Comparative Example: |
| 1 | Bisphenol-Z polycarbonate resin (weight-average molecular weight: 20,000) |
| 2 | Polymethyl methacrylate resin (weight-average molecular weight: 40,000) |

TABLE 2

| | Photosensitive layer specific dielectric constant | Initial performances Vd (V) | Sensitivity ($\mu$J/cm$^2$) | Vsl (V) | Running-test images | Scrape (per 10,000 sheets) ($\mu$m) | Running-test potential variations ΔVd (V) | ΔV1 (V) | ΔVs1 (V) |
|---|---|---|---|---|---|---|---|---|---|
| Example: | | | | | | | | | |
| 1 | 3.0 | −705 | 0.32 | −70 | Good | 1.3 | 5 | 10 | 10 |
| 2 | 3.3 | −705 | 0.33 | −90 | Good | 1.5 | 5 | 5 | 10 |
| 3 | 2.8 | −700 | 0.30 | −70 | Good | 1.3 | 0 | 10 | 15 |
| 4 | 3.3 | −700 | 0.35 | −85 | Good | 2.0 | 5 | −5 | 5 |
| 5 | 3.2 | −705 | 0.33 | −80 | Good | 1.2 | 5 | 10 | 10 |

TABLE 2-continued

| | Photo-sensitive layer specific dielectric constant | Initial performances Vd (V) | Sensitivity ($\mu$J/cm$^2$) | Vsl (V) | Running-test images | Scrape (per 10,000 sheets) ($\mu$m) | Running-test potential variations ΔVd (V) | ΔV1 (V) | ΔVs1 (V) |
|---|---|---|---|---|---|---|---|---|---|
| Comparative Example: | | | | | | | | | |
| 1 | 3.0 | −700 | 0.29 | −60 | Image density decreased on 10,000th sheet | 5.7 | 10 | −70 | 10 |
| 2 | 3.0 | −700 | 0.31 | −70 | Fog appeared after 5,000 sheets | 12.5 | 380 | 30 | 20 |
| 3 | 3.2 | −700 | Attenuation to 150 V impossible | −230 | Unsharp from the beginning | 2.0 | — | — | — |

TABLE 3

| | Deposition | Solvent cracking After 24 hrs | After 2 days |
|---|---|---|---|
| Example: | | | |
| 1 | Not seen | Not seen | Not seen |
| 2 | Not seen | Not seen | Not seen |
| 3 | Not seen | Not seen | Not seen |
| 4 | Not seen | Not seen | Not seen |
| 5 | Not seen | Not seen | Not seen |
| Comparative Example: | | | |
| 1 | Deposited after 20 days | Not seen | Cracking occurred |
| 2 | Deposited after 3 days | Cracking occurred | Cracking occurred |
| 3 | Not seen | Not seen | Not seen |

EXAMPLES 6 to 9

Electrophotographic photosensitive members were produced in the same manner as in Example 1 except that the compound having an acryloyloxy group ($CH_2$═CHCOO—) was replaced respectively with those shown in Table 4. Evaluation was made similarly.

The results are shown in Tables 6 and 7. As can be seen from Tables 6 and 7, all the photosensitive members show good performances and cause neither deposition nor solvent cracking. However, as can be seen from Table 6, they show tendencies of a lower sensivity and a higher residual potential when the photosensitive layer has a specific dielectric constant of above 4.0.

TABLE 4

| Example: | |
|---|---|
| 6 | Epoxyacrylate oligomer (VISCOAT 540, available from Osaka Organic Chemical) |

TABLE 4-continued

| Example: | |
|---|---|
| 7 | 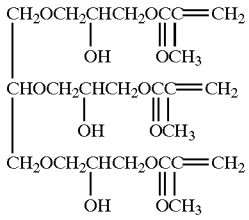 |
| 8 | 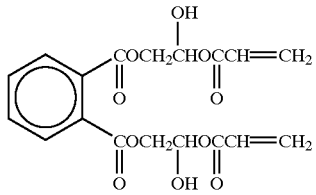 |
| 9 | 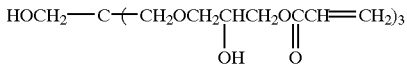 |

EXAMPLES 10 to 14

Electrophotographic photosensitive members were produced in the same manner as in Example 1 except that the conditions for irradiation by electron rays were changed as shown in Table 5. Evaluation was made similarly.

The results are shown in Tables 6 and 7. As can be seen from Tables 6 and 7, all the photosensitive members show good performances and cause neither deposition nor solvent cracking. However, as can be seen from Table 6, they show tendencies of a lower sensitivity and a higher residual potential when the electron rays are applied at an accelerating voltage higher than 250 kV and in an irradiation dose larger than 100 Mrad.

TABLE 5

| Example: | Electron rays: Accelerating voltage (kV) | Electron rays: Irradiation dose (Mrad) |
|---|---|---|
| 10 | 200 | 30 |
| 11 | 300 | 30 |
| 12 | 150 | 80 |
| 13 | 150 | 150 |
| 14 | 150 | 200 |

TABLE 6

| Example: | Photo-sensitive layer specific dielectric constant | Initial performances: Vd (V) | Initial performances: Sensitivity ($\mu J/cm^2$) | Initial performances: Vsl (V) | Running-test images | Scrape (per 10,000 sheets) ($\mu m$) | Running-test potential variations: ΔVd (V) | Running-test potential variations: ΔV1 (V) | Running-test potential variations: ΔVs1 (V) |
|---|---|---|---|---|---|---|---|---|---|
| 6 | 3.5 | −705 | 0.36 | −90 | Good | 1.8 | 5 | 15 | −10 |
| 7 | 4.2 | −705 | 0.43 | −110 | Good | 1.5 | 10 | 15 | 20 |
| 8 | 4.1 | −700 | 0.43 | −100 | Good | 2.0 | 15 | 20 | 25 |
| 9 | 4.4 | −700 | 0.45 | −120 | Good | 1.8 | 15 | 20 | 30 |
| 10 | 3.2 | −705 | 0.32 | −70 | Good | 1.2 | 5 | −10 | −10 |
| 11 | 3.4 | −700 | 0.35 | −90 | Good | 1.2 | 5 | −25 | −30 |
| 12 | 3.4 | −695 | 0.34 | −90 | Good | 1.3 | 5 | 10 | 5 |
| 13 | 3.5 | −695 | 0.38 | −100 | Good | 1.6 | 10 | −15 | −20 |
| 14 | 3.6 | −700 | 0.43 | −110 | Good | 1.8 | 5 | −20 | −30 |

TABLE 7

| Example: | Deposition | Solvent cracking: After 24 hrs | Solvent cracking: After 2 days |
|---|---|---|---|
| 6 | Not seen | Not seen | Not seen |
| 7 | Not seen | Not seen | Not seen |
| 8 | Not seen | Not seen | Not seen |
| 9 | Not seen | Not seen | Not seen |
| 10 | Not seen | Not seen | Not seen |
| 11 | Not seen | Not seen | Not seen |
| 12 | Not seen | Not seen | Not seen |
| 13 | Not seen | Not seen | Not seen |
| 14 | Not seen | Not seen | Not seen |

What is claimed is:

1. An electrophotographic photosensitive member comprising a conductive support and a photosensitive layer formed thereon;

wherein the electrophotographic photosensitive member has a surface layer containing a charge-transporting material and a resin obtained by exposing to electron rays at an accelerating voltage of 150 kV or below in an irradiation dose of from 1 Mrad to 100 Mrad, a monomer compound having an acryloyloxy group or methacryloyloxy group to cure without employing a thermo- or photo-reaction initiator, wherein said monomer compound contains a moiety selected from the group consisting of a trimethylolpropane, a pentaerythritol, an isocyanurate and an alicyclic; and wherein said photosensitive layer has a specific dielectric constant of 4.0 or below.

2. The electrophotographic photosensitive member according to claim 1, wherein said photosensitive layer has a charge generation layer and a charge transport layer, and the charge transport layer is said surface layer.

3. The electrophotographic photosensitive member according to claim 1, wherein said surface layer is a layer obtained by coating a solution containing the monomer compound having an acryloyloxy group or methacryloyloxy group, followed by exposure to electron rays to effect curing.

4. The electrophotographic photosensitive member according to claim 3, wherein said solution contains the charge-transporting material.

5. The electrophotographic photosensitive member according to claim 1, wherein said monomer compound having an acryloyloxy group or methacryloyloxy group is a polyfunctional compound.

6. The electrophotographic photosensitive member according to claim 1, wherein said photosensitive layer has a specific dielectric constant of 3.5 or below.

7. The electrophotographic photosensitive member according to claim 1, wherein said electron rays are applied in an irradiation dose of from 3 Mrad to 50 Mrad.

8. A process for forming a surface layer of an electrophotographic photosensitive member comprising a conductive support and a photosensitive layer formed thereon, said electrophotographic photosensitive member having a specific dielectric constant of 4.0 or below, the process comprising the steps of:

(a) coating a solution containing a monomer compound having an acryloyloxy group or methacryloyloxy group, wherein said monomer compound contains a moiety selected from the group consisting of a trimethylolpropane, a pentaerythritol, an isocyanurate and an alicyclic and a charge-transporting material to form the surface layer; and (b) exposing the layer to electron rays at an accelerating voltage of 150 kV or below in an irradiation dose of from 1 Mrad to 100 Mrad to cure the compound without employing a thermo- or photo-reaction initiator and form the surface layer.

9. The process according to claim 8, wherein said photosensitive layer has a charge generation layer and a charge transport layer, and the charge transport layer is said surface layer.

10. The process according to claim 8, wherein said monomer compound having an acryloyloxy group or methacryloyloxy group is a polyfunctional compound.

11. The process according to claim 8, wherein said photosensitive layer has a specific dielectric constant of 3.5 or below.

12. The process according to claim 8, wherein said electron rays are applied in an irradiation dose of from 3 Mrad to 50 Mrad.

13. A process cartridge comprising an electrophotographic photosensitive member and a means selected from the group consisting of a charging means, a developing means and a cleaning means;

said electrophotographic photosensitive member and at least one of said means being supported as one unit and being detachably mountable to the main body of an electrophotographic apparatus; and said electrophotographic photosensitive member comprising a conductive support and a photosensitive layer formed thereon;

which electrophotographic photosensitive member has a surface layer containing a charge-transporting material and a resin obtained by exposing to electron rays at an accelerating voltage of 150 kV or below in an irradiation dose of from 1 Mrad to 100 Mrad a monomer compound having an acryloyloxy group or methacryloyloxy group to cure without employing a thermo- or photo-reaction initiator, wherein said monomer compound contains a moiety selected from the group consisting of a trimethylolpropane, a pentaerythritol, an isocyanurate and an alicyclic, and wherein said photosensitive layer has a specific dielectric constant of 4.0 or below.

14. An electrophotographic apparatus comprising an electrophotographic photosensitive member, a charging means, an exposure means, a developing means and a transfer means;

said electrophotographic photosensitive member comprising a conductive support and a photosensitive layer formed thereon;

which electrophotographic photosensitive member has a surface layer containing a charge-transporting material and a resin obtained by exposing to electron rays at an accelerating voltage of 150 kV or below in an irradiation dose of from 1 Mrad to 100 Mrad, a monomer compound having an acryloyloxy group or methacryloyloxy group to cure without employing a thermo- or photo-reaction initiator, wherein said monomer compound contains a moiety selected from the group consisting of a trimethylolpropane, a pentaerythritol, an isocyanurate and an alicyclic, and wherein said photosensitive layer has a specific dielectric constant of 4.0 or below.

* * * * *